US005435393A

United States Patent [19]

Brekke et al.

[11] Patent Number: 5,435,393

[45] Date of Patent: Jul. 25, 1995

[54] PROCEDURE AND PRODUCTION PIPE FOR PRODUCTION OF OIL OR GAS FROM AN OIL OR GAS RESERVOIR

[75] Inventors: Kristian Brekke, Oslo; Jon P. Sargeant, Lommedalen, both of Norway

[73] Assignee: Norsk Hydro a.s., Oslo, Norway

[21] Appl. No.: 120,788

[22] Filed: Sep. 15, 1993

[30] Foreign Application Priority Data

Sep. 18, 1992 [NO] Norway ..... 923628

[51] Int. Cl.[6] ..... E21B 43/12

[52] U.S. Cl. ..... 166/370; 166/50; 166/236; 166/316; 166/373

[58] Field of Search ..... 166/369, 370, 373, 50, 166/205, 235, 236, 316, 243

[56] References Cited

U.S. PATENT DOCUMENTS

| | | | |
|---|---|---|---|
| 4,940,094 | 7/1990 | Lessi et al. | 166/373 |
| 4,949,788 | 8/1990 | Szarka et al. | 166/373 X |
| 5,269,376 | 12/1993 | Gadelle et al. | 166/369 X |

FOREIGN PATENT DOCUMENTS

| | | |
|---|---|---|
| 902544 | 12/1991 | Norway . |
| 2169018 | 7/1986 | United Kingdom . |

*Primary Examiner*—Terry Lee Melius
*Attorney, Agent, or Firm*—Wenderoth, Lind & Ponack

[57] ABSTRACT

A production pipe for production of oil or gas from a well in an oil and/or gas reservoir, or for injection of fluids into a well in an oil and/or gas reservoir, includes a production pipe with a lower drainage pipe. The drainage pipe is divided into sections with one or more inflow restriction devices which control the flow of oil or gas from the reservoir into the drainage pipe on the basis of calculated loss of friction pressure along the drainage pipe, the calculated productivity profile of the reservoir, and the calculated inflow of gas or water.

20 Claims, 4 Drawing Sheets

PROCEDURE AND PRODUCTION PIPE FOR PRODUCTION OF OIL OR GAS FROM AN OIL OR GAS RESERVOIR

BACKGROUND OF THE INVENTION

The present invention relates to a method for producing oil or gas from a well in an oil or gas reservoir, or of injecting fluids into a well in an oil or gas reservoir. The invention further relates to a production pipe with a lower drainage pipe for use in such methods. The invention is particularly suitable for long, horizontal wells in thin oil zones in highly permeable geological formations.

Devices for recovery of oil and gas from long, horizontal and vertical wells are known from U.S. Pat. Nos. 4,821,801, 4,858,691, and 4,577,691 and GB Patent No. 2,169,018. Each of these known devices comprises a perforated drainage pipe with, for example, a filter for control of sand round the pipe. A considerable disadvantage of such known devices for oil and/or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by such means will therefore be low. With thin oil zones and highly permeable geological formations, there is a high risk of coning, i.e. flow of unwanted water or gas into the drainage pipe downstream, where the velocity of the oil flow from the reservoir to the pipe is greater. To avoid this coning, the production rate must therefore be further reduced.

A somewhat higher production rate than that obtained by means of the known methods mentioned above can be achieved using the Stinger method, which is described in Norwegian patent application No. 902,544. Such method employs two drainage pipes, namely an outer, perforated pipe, and an inner pipe (Stinger) without perforations and which extends into the outer pipe to a desired position. The pressure profile and thus productivity achieved by means of the Stinger method are somewhat better than those achieved by other known methods. In thin oil zones with a high permeability, however, coning of unwanted water or gas may occur with this method also, resulting in reduced productivity.

The technology for drilling horizontal wells was known in 1920, but nevertheless there are many people today who regard it as pioneering technology. For the past twenty years work has been continuously in progress to develop means of drilling horizontal wells in a prudent, effective manner. The current state of technology offers high drilling safety and costs approximately 50% higher than for vertical wells. However, horizontal wells produce three to four times as much, depending on the nature of the reservoir.

It has been proven that horizontal wells are an economic necessity for recovering oil from geological formations with a thin oil zone, high permeability and in which coning of unwanted water or gas often occurs. It is anticipated that horizontal wells will be even more important in the future for exploiting small and economically marginal oil and gas fields. As well-drilling technology developed, the requirements made of reservoir drainage technology were also intensified. As described above, the known drainage technology of today has no satisfactory solutions for controlled drainage from and injection into different zones along a horizontal well.

SUMMARY OF THE INVENTION

The object of the present invention is to improve the pressure profile in a drainage pipe beyond what is known from the solutions mentioned above, by introducing restrictions which limit the pressure differential between the reservoir and an annular space outside the drainage pipe, and thereby straighten out the pressure profile along the well immediately outside the drainage pipe.

According to the invention, such object is achieved by providing that the drainage pipe is divided into sections with one or more inflow restriction devices which control the flow of oil or gas from the reservoir into the drainage pipe on the basis of anticipated loss of friction pressure along the drainage pipe, the reservoir's anticipated productivity profile and anticipated inflow of gas or water.

BRIEF DESCRIPTION OF THE DRAWINGS

The invention now will be described in more detail, with reference to the accompanying drawings, in which.

DETAILED DESCRIPTION OF THE INVENTION

Figure 1:
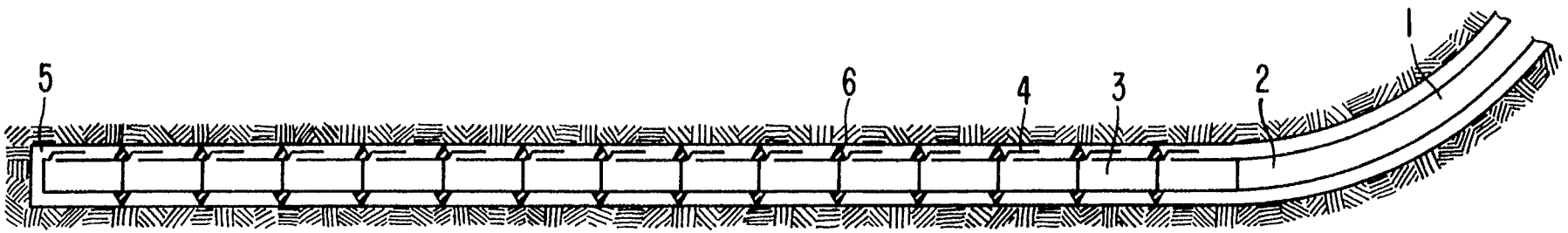
FIG. 1 is a vertical section through a horizontal well in which is placed a production pipe according to the invention.

FIG. 1 shows schematically a vertical section through a drainage pipe according to the invention for a horizontal production well (not shown in more detail) for recovery of oil or gas in an oil and/or gas reservoir. A lower part of a production pipe 1 is a horizontal drainage pipe 2 formed of one or more sections 3 along the entire length of the pipe 2, and one or more inflow restriction devices 4, a filter 5 when the geological production formation requires it, and a sealing device 6 between adjacent sections 3, which forms a seal between the drainage pipe 2 and the geological well formation.

FIGS. 2A–3B show two examples of inflow restriction devices 4 for the drainage pipe 2, the function of the inflow restriction devices is to prevent uncontrolled flow from the reservoir into the drainage pipe by evening out the loss of friction pressure immediately outside and along the entire length of the drainage pipe. The inflow restriction devices are the only connection between the reservoir and the interior of the drainage pipe.

Figure 2A:
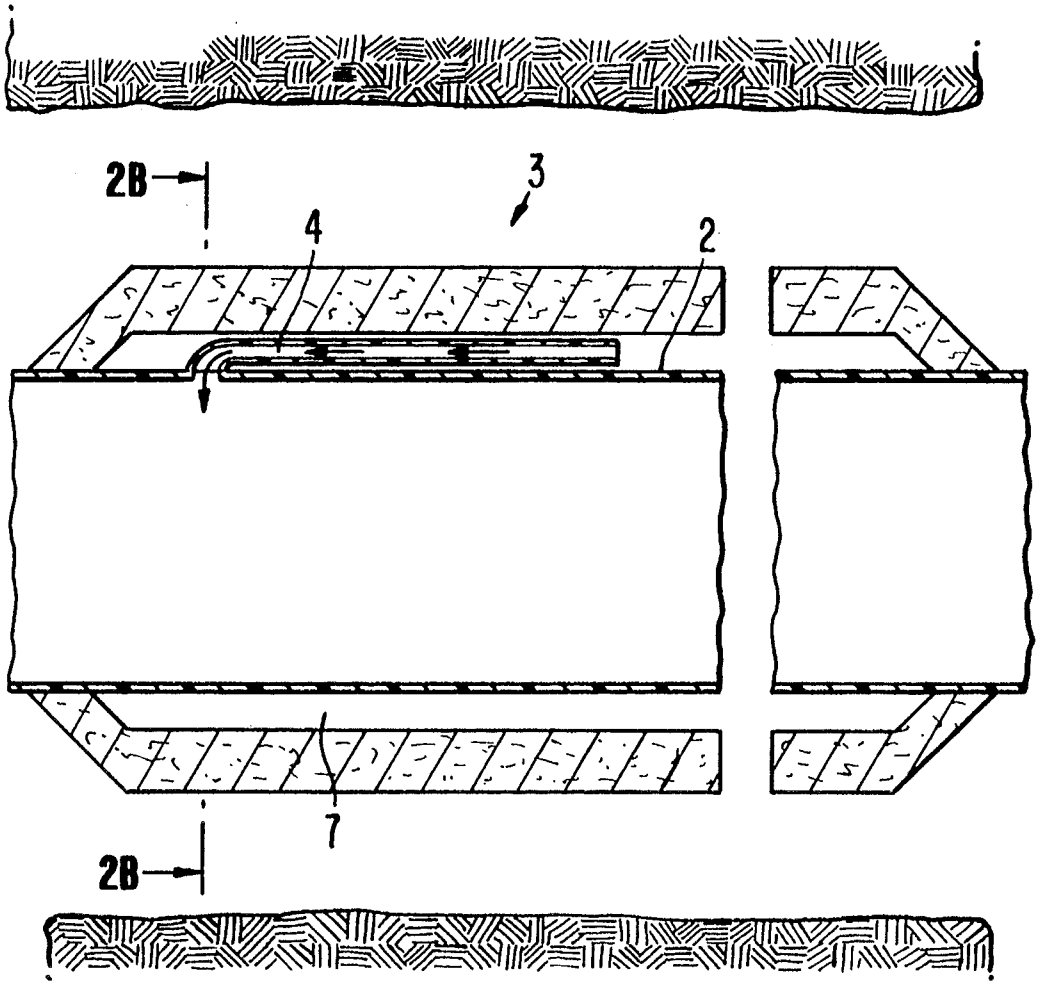
FIGS. 2A and 2B are axial and transverse sections, respectively, on an enlarged scale, through the drainage pipe shown in FIG. 1, and illustrating a filter, an inflow restriction device and an annular space for inflow of fluid.
Figure 2B:
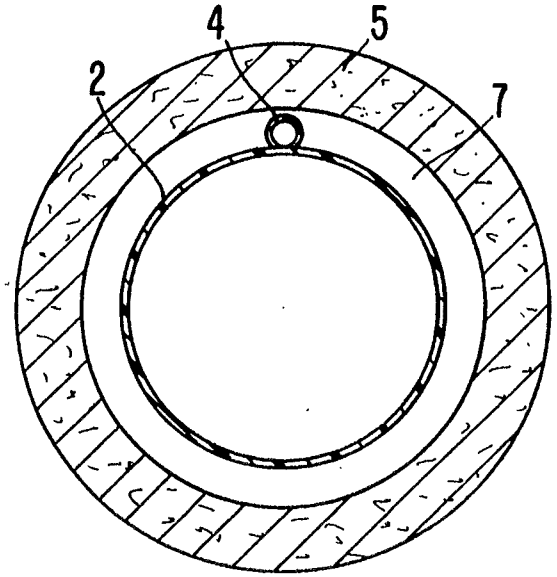

FIGS. 2A and 2B are sections through the drainage pipe as shown in FIG. 1. Fluid flows through the permeable geological formation to the sand control filter 5 and through such filter to an annular space 7. Then, as a result of the differential pressure between the reservoir and the drainage pipe, such fluid flows towards and through the inflow restriction device 4 and into the interior of the drainage pipe.

Figure 3A:
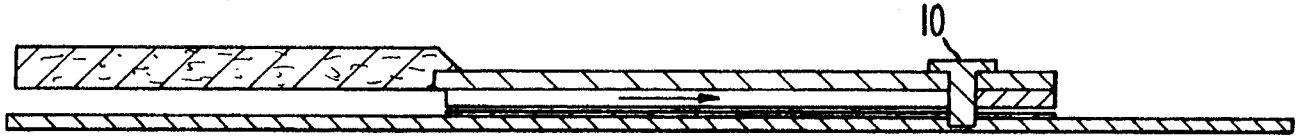
FIGS. 3, 3A and 3B respectively are a perspective view and axial sections, on an enlarged scale, through the drainage pipe as shown in FIG. 1, but with an alternative inflow restriction device.
Figure 3B:
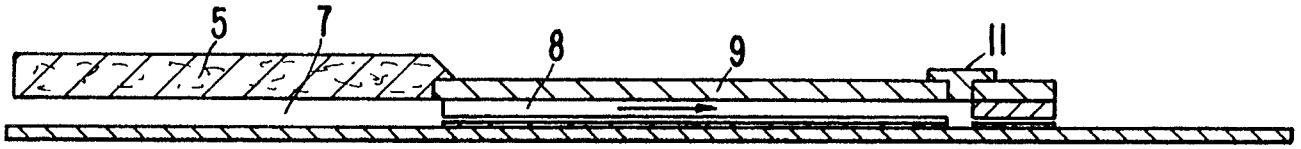
Figure 3:
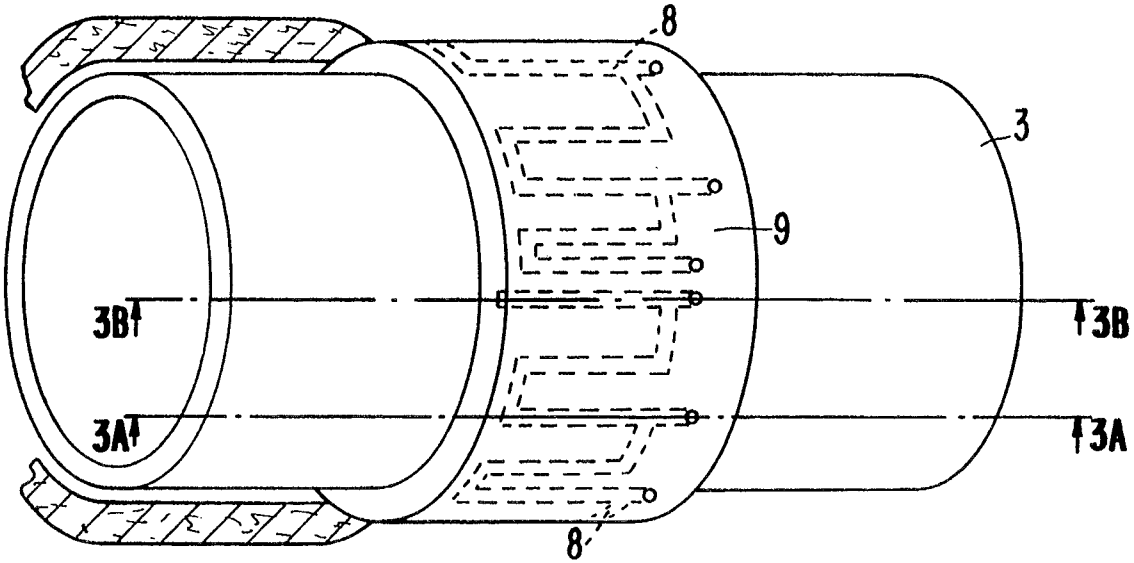

FIGS. 3-3B are sections through a drainage pipe with an alternative inflow restriction device. In this embodiment, the inflow restriction device includes a thickened portion or member in the form of a sleeve or tube 9 equipped with one or more inflow channels 8 which permit inflow of fluid. Such fluid inflow can be regulated by means of one or more screw or plug devices 10 and 11. The device 10 of FIG. 3A shows a situation in which an inflow channel is closed, and device 11 of FIG. 3B shows a situation in which an inflow channel is open. In this manner, by using short or long screws which extend into the channels as shown, the length of the open through flow sections of the channels, and thereby the flow of oil to the drainage pipe for each section can be varied. However, instead of using short and long screws, and keeping the channels open or closed, it is possible instead to use medium sized screws or pin regulating devices which extend partially into the channels and which are designed to regulate the through flow cross section of the channels. It is advisable to preset the screws before the drainage pipe is placed in the well, but driven pin regulating or screw devices with remote control also can be used. Throughgoing slots or holes in the drainage pipe with a surrounding sleeve which is adjustable in the longitudinal direction for each section also can be used.

Figure 4:
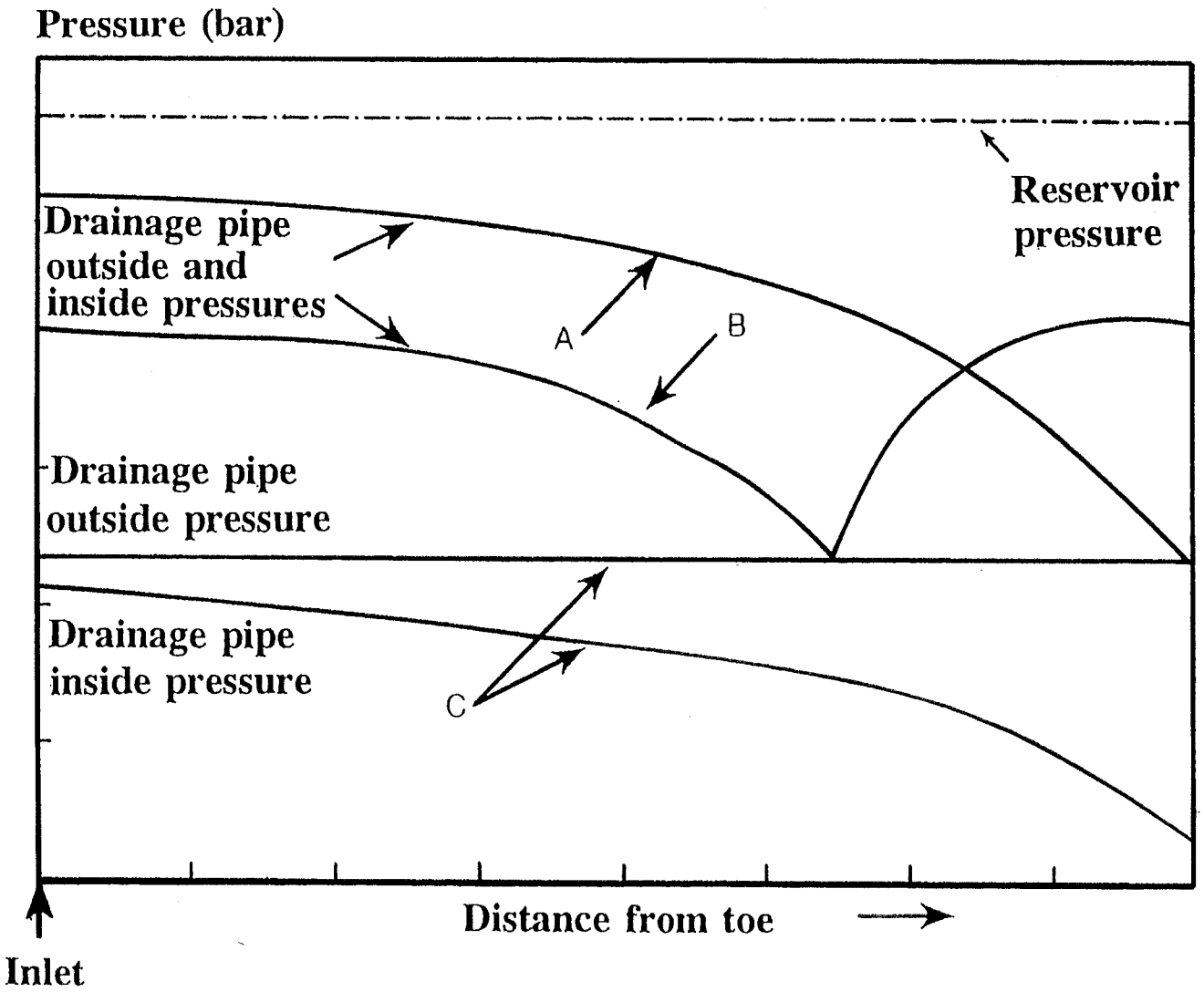
FIG. 4 is a graph illustrating, by mathematically stimulated examples, pressure profiles along a drainage pipe obtained by the invention, compared with known solutions.

FIG. 4 shows three curves which illustrate a comparison between a pressure profile of the invention and pressure profiles of known solutions. Such curves show the results of mathematical model simulations. On the y axis, well and production pipe pressure is given in bars, and on the x axis the length of the production pipe is given in meters. Pressure curves A and B are known solutions, and curve C is for the invention. The reservoir pressure is shown as a straight line at the top.

The most favorable condition for productivity is to achieve a pressure curve along a homogeneous formation which is even and nearly horizontal with an evenly distributed flow into the drainage pipe. An evening out of the loss of friction pressure along the entire length of the drainage pipe thereby is achieved. In pressure curve C, representing the invention, this is achieved, but not in pressure curves A and B, which are the known solutions.

Curve A indicates how the pressure profile rises with the length of the drainage pipe in the upstream direction for continuously perforated production piping with an internal diameter of about 15 cm. Curve B, the Stinger method, has a pressure profile which is lower on average than curve A, but has the same form as far as the Stinger tube's entry, and then rises. The overall effect, then, is that curve B gives a somewhat higher productivity over the whole length of the drainage pipe than does curve A. Curve C, which represents the invention, given a steady, horizontal and low pressure profile over the entire length of the drainage pipe, and is the most beneficial solution, and the one which will result in the highest productivity.

We claim:

1. A method of production of oil or gas from a horizontal well defined within an oil or gas reservoir, said method comprising:

positioning directly within said well a drainage pipe to receive in an interior thereof oil or gas from said reservoir;

dividing said drainage pipe exteriorly thereof into longitudinally separate sections each receiving individually oil or gas pressure from said reservoir;

providing each said separate section with at least one inflow restriction device communicating the exterior of said each section with said interior of said drainage pipe; and regulating the pressure profile along said drainage pipe by controlling individually the amount of flow of oil or gas from said reservoir through said at least one inflow restriction device of each said section.

2. A method as claimed in claim 1, comprising conducting said controlling as a function of a calculated loss of friction pressure along said drainage pipe.

3. A method as claimed in claim 1, comprising conducting said controlling as a function of a calculated productivity profile of said reservoir.

4. A method as claimed in claim 1, comprising conducting said controlling as a function of a calculated inflow of gas or water from said reservoir.

5. A method as claimed in claim 1, comprising conducting said controlling to provide said pressure profile to be generally rectilinear substantially along the length of said drainage pipe.

6. A method as claimed in claim 1, wherein said dividing comprises positioning longitudinally spaced exterior seals in sealing contact with said reservoir.

7. A method as claimed in claim 1, wherein said positioning comprises providing an annular space between said reservoir and the exterior of said drainage pipe, and said dividing comprises abutting longitudinally spaced seals with said reservoir, thereby separating said annular space into separate annular chambers connectable to said interior of said drainage pipe through respective said inflow restriction devices.

8. A method as claimed in claim 7, comprising preventing flow of oil or gas between said annular chambers and said interior of said drainage pipe other than through said inflow restriction devices.

9. A drainage pipe to be positioned directly within a horizontal well defined within an oil or gas reservoir for the production of oil or gas therefrom, said drainage pipe comprising:

a pipe interior to receive oil or gas to be conveyed to a production pipe;

exterior dividers dividing said drainage pipe exteriorly thereof into longitudinally separate sections each to receive individually oil or gas pressure from the reservoir;

each said separate section of said drainage pipe having therein at least one regulatable inflow restriction device, extending from the exterior of said each section to said pipe interior, to control the amount of flow of oil or gas from the reservoir through said each section into said pipe interior, and thereby to regulate the pressure profile along said drainage pipe.

10. A drainage pipe as claimed in claim 9, wherein said exterior dividers comprise longitudinally spaced seals on the exterior of said drainage pipe to be brought into sealing contact with the reservoir.

11. A drainage pipe as claimed in claim 9, wherein said drainage pipe is imperforate except for said inflow restriction devices.

12. A drainage pipe as claimed in claim 9, wherein each said inflow restriction device has an inlet constructed to be in contact with a surface of the reservoir.

13. A drainage pipe as claimed in claim 9, further comprising, for each said section, a filter defining an annular chamber with said exterior of said each section.

14. A drainage pipe as claimed in claim 13, wherein said inflow restriction devices are positioned in respective said annular chambers.

15. A drainage pipe as claimed in claim 13, wherein each said inflow restriction device has an inlet opening into a respective said annular chamber and an outlet opening into said pipe interior.

16. A drainage pipe as claimed in claim 9, wherein each said inflow restriction device comprises at least one inflow channel.

17. A drainage pipe as claimed in claim 16, wherein said thickened portion comprises a sleeve fitted on said drainage pipe.

18. A drainage pipe as claimed in claim 16, wherein each said inflow restriction device comprises plural inflow channels.

19. A drainage pipe as claimed in claim 18, wherein said inflow channels are located within a thickened portion of said drainage pipe.

20. A drainage pipe as claimed in claim 18, further comprising plugs to vary the length, number and cross section of said inflow channels.

* * * * *